US008875542B2

(12) United States Patent
Severs

(10) Patent No.: US 8,875,542 B2
(45) Date of Patent: Nov. 4, 2014

(54) MAGNETIC INTERCHANGEABLE JEWELRY

(76) Inventor: Noah Severs, Lebanon, NH (US)

( * ) Notice: Subject to any disclaimer, the term of this patent is extended or adjusted under 35 U.S.C. 154(b) by 0 days.

(21) Appl. No.: 13/350,776

(22) Filed: Jan. 15, 2012

(65) Prior Publication Data

US 2012/0180522 A1 Jul. 19, 2012

Related U.S. Application Data

(60) Provisional application No. 61/433,320, filed on Jan. 17, 2011.

(51) Int. Cl.
*A44C 25/00* (2006.01)
*A44C 17/02* (2006.01)

(52) U.S. Cl.
CPC ..... *A44C 17/0208* (2013.01); *A44D 2203/00* (2013.01); *Y10S 63/90* (2013.01)
USPC ..... 63/40; 63/900; 63/33; 24/303

(58) Field of Classification Search
USPC ..... 63/900, 29.2, 40, 33; 24/303
See application file for complete search history.

(56) References Cited

U.S. PATENT DOCUMENTS 3,009,225 A * 11/1961 Budreck ..... 24/303
3,041,697 A * 7/1962 Budreck ..... 24/303
3,086,268 A * 4/1963 Chaffin, Jr. ..... 24/303
3,141,216 A * 7/1964 Haskell ..... 24/303
3,324,521 A * 6/1967 Humiston ..... 24/303
4,480,361 A * 11/1984 Morita ..... 24/303
5,042,116 A * 8/1991 Ossiani ..... 24/303
5,142,746 A * 9/1992 Morita ..... 24/303
5,379,495 A * 1/1995 Riceman et al. ..... 24/303
5,432,986 A * 7/1995 Sexton ..... 24/303
5,630,258 A * 5/1997 Schneider ..... 24/303
5,983,464 A * 11/1999 Bauer ..... 24/303
6,131,247 A * 10/2000 Morita ..... 24/303
6,564,434 B1 * 5/2003 Morita ..... 24/303
6,978,521 B2 * 12/2005 Morita ..... 24/303
7,246,384 B2 * 7/2007 Bentz ..... 2/421
2004/0154143 A1 * 8/2004 Harrell ..... 24/303
2007/0028429 A1 * 2/2007 Ishida ..... 24/303
2011/0214260 A1 * 9/2011 Wang ..... 24/303

* cited by examiner

*Primary Examiner* — Victor Batson
*Assistant Examiner* — Abigail Morrell

(57) ABSTRACT

The present invention is a jewelry device comprising a base unit which may be affixed to clothing or otherwise adapted to be worn on a person and a front unit which concentrically fits inside base unit and either serves as an enclosure for an ornamented object or itself bears ornamentation. Base unit contains a ring or radial magnet which is of a shape to fit inside the inner perimeter of base unit. Front unit contains a ring or radial magnet which is of a shape to fit around the outside perimeter of front unit. Both front unit and base unit magnets are of a similar circumference allowing magnetic forces to secure front unit to base unit. Front unit, or ornamented objects enclosed by front unit, are interchangeable with other like elements bearing different ornamentation.

8 Claims, 5 Drawing Sheets

MAGNETIC INTERCHANGEABLE JEWELRY

CROSS-REFERENCE TO RELATED APPLICATIONS

This application claims the benefit of U.S. Provisional Application No. 61/433,320, filed Jan. 17, 2011.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention is in the technical field of jewelry. More particularly it relates to jewelry which utilizes ornamented interchangeable components held by magnetic attraction to a base element.

U.S. Pat. No. 2,752,764 issued Jul. 3, 1956 discloses an earring which utilizes interchangeable ornaments via fixture of flat magnets.

U.S. Pat. No. 4,913,944 issued Apr. 3, 1990 discloses a jewelry article comprising a base element which supports an ornamented substrate element thereon by magnetic attraction, both the base element and substrate element having magnetically attractable properties and at least one of them having the properties of a permanent magnet, whereby the substrate element is interchangeable with other like elements bearing different ornamentation.

SUMMARY OF THE INVENTION

The present invention is an article of jewelry composed of a base unit and front unit which may itself be ornamented on one or both sides or in an alternate configuration may serve as an enclosure for an additional non-magnetic interchangeable insert. Both base unit and front unit utilize ring or radial magnets to create attractive forces between the two allowing for interchangeability of like base units, front units, and or non-magnetic inserts.

DETAILED DESCRIPTION OF THE INVENTION

Referring now to the invention in more detail, in FIG. 1 to FIG. 4 there is shown a jewelry device 100 comprised of a base unit 101, and front unit 104.

Figure 1:
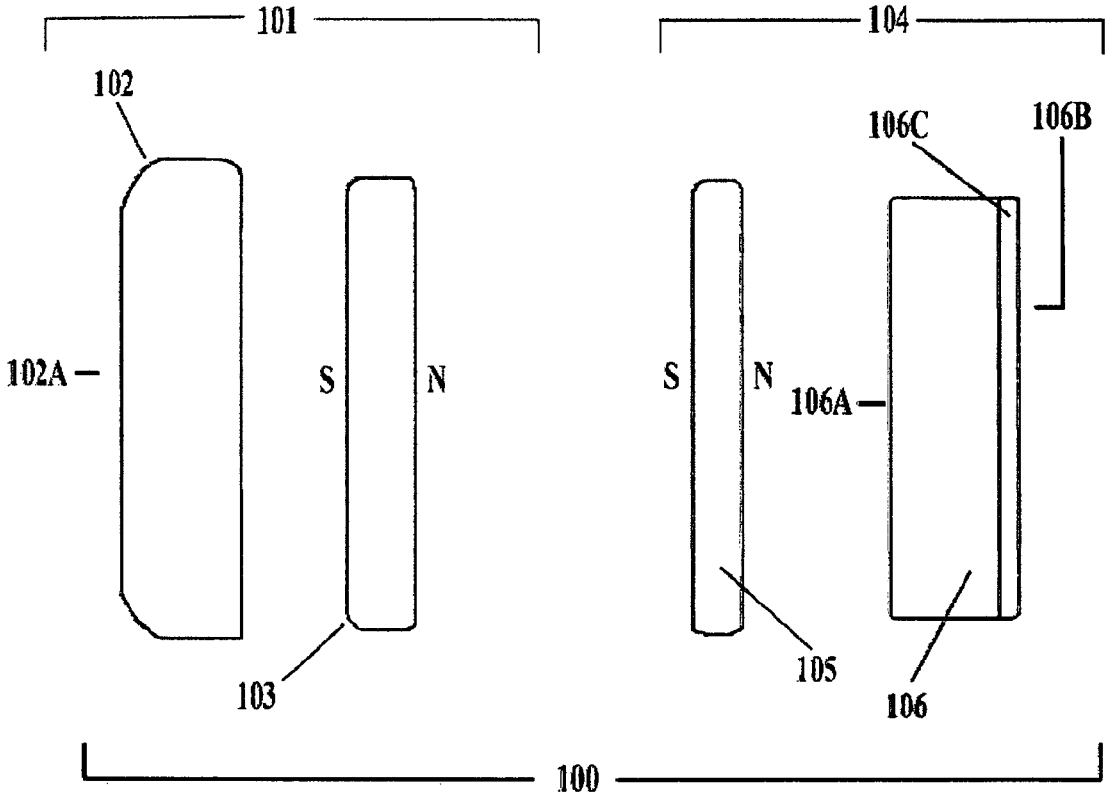
FIG. 1 is an exploded side view of a device of the present invention.
Figure 2:
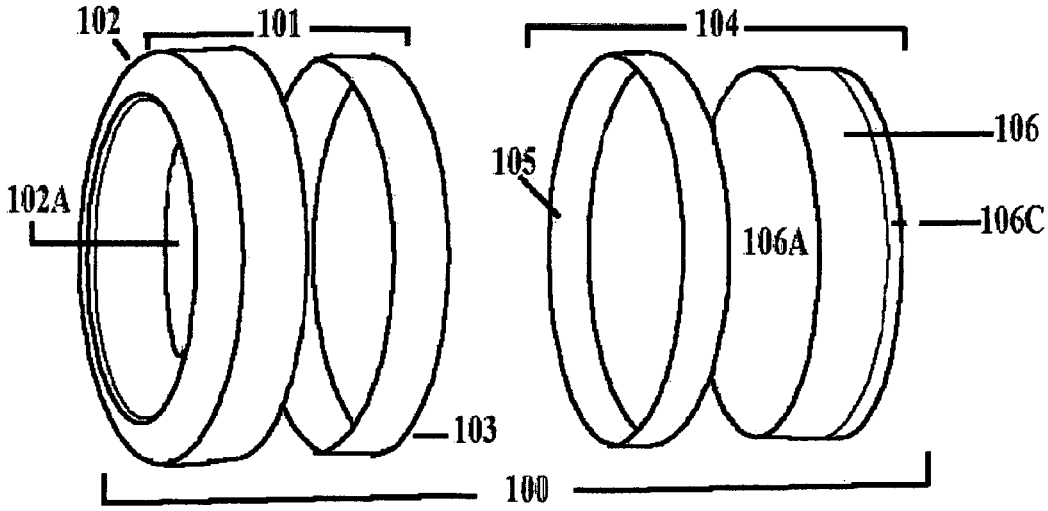
FIG. 2 is an exploded perspective view of a device of FIG. 1.
Figure 3:
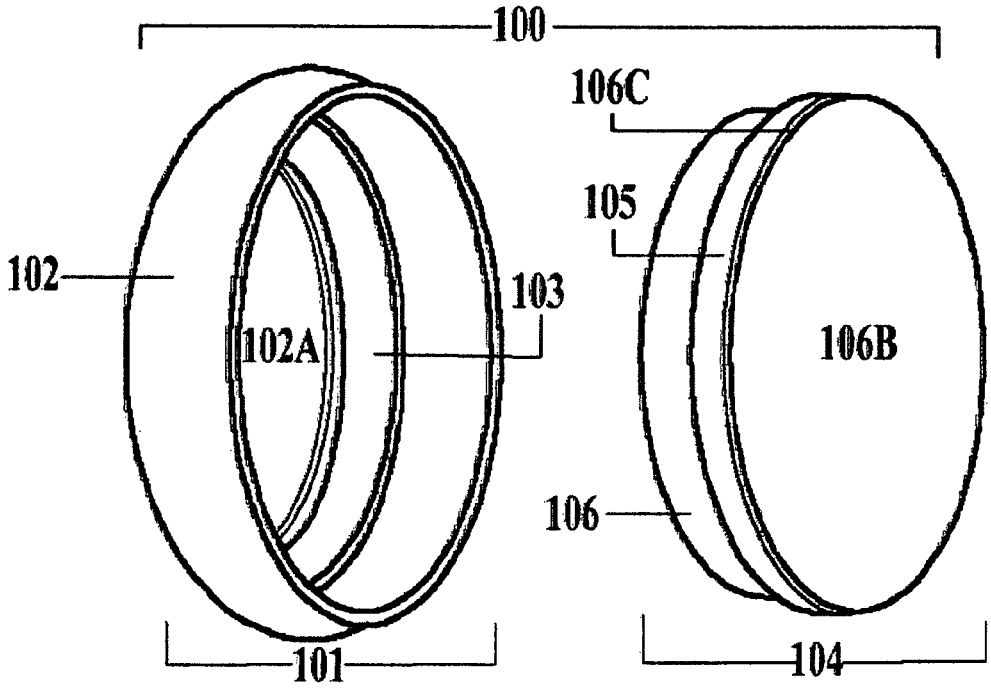
FIG. 3 is a perspective view of a device of FIGS. 1 & 2 with front and base units separated.

The base unit 101 includes a magnet 103 and a receptacle piece 102 which may be referred to as a female member. Base unit 101 may be adapted to be worn on the person by affixing base unit 101 to a mounting such as a ring or a pendant bail. In FIG. 1 to FIG. 4 base unit 101 is not shown with such adaptation but it may, within the purview of the invention take on any number of forms such as for example a ring, a pendant, a cufflink, a bracelet, a bangle, a brooch, a tie clip, or an earring. The magnet 103 is of a shape as to fit inside the inner perimeter of the receptacle piece 102 and is secured in place via an adhesive (not shown). The magnet 103 has a North Pole and a South Pole which are displayed in FIG. 1 with the North Pole depicted as facing outward towards the front unit 104. The back face 102A of the receptacle piece 102 may have an opening 102A as depicted in FIGS. 2 & 3. The front unit 104 includes a magnet 105 and an insert 106 which may be referred to as a male member. Insert 106 may be ornamented on the back face 106A, the front face 106B, both faces 106A and 106B, or neither face. Insert 106 is of sufficient size and shape to fit inside base unit 101. Insert 106 may have a raised ridge 106C positioned behind magnet 105. The magnet 105 is of a shape as to fit around the outside perimeter of insert 106 and is secured in place via an adhesive (not shown). The magnet 105 has a North Pole and a South Pole which are displayed in FIG. 1 with the South Pole depicted as facing towards the base unit 101.

Figure 4:
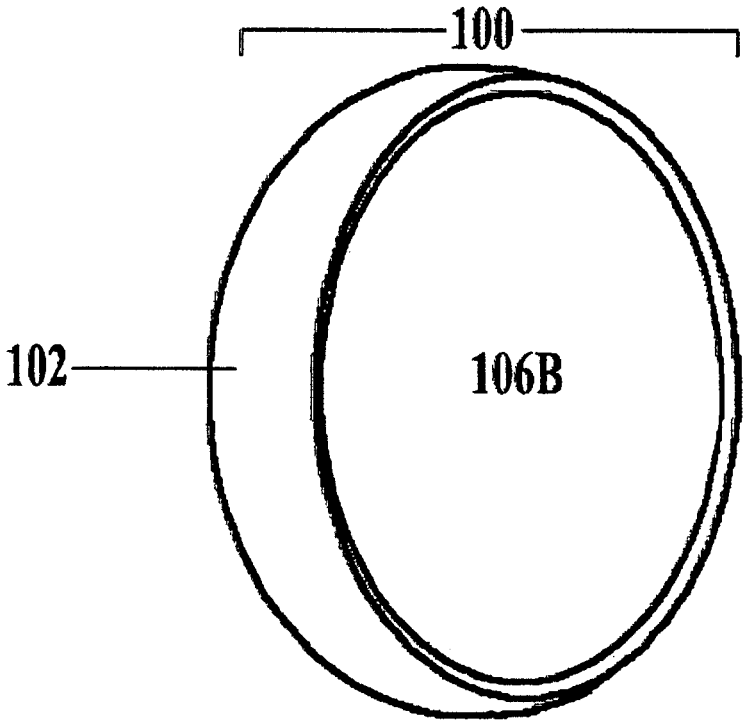
FIG. 4 is a perspective view of a device of FIGS. 1, 2, and 3 with front and base units assembled together.

In more detail, still referring to the invention of FIG. 1 to FIG. 4 the front unit 104 may be fitted together with the base unit 101 by force of magnetic attraction between magnet 103 on base unit 101 and magnet 105 on front unit 104. Magnet 103 and magnet 105 must be assembled on their respective bodies so that opposite poles are facing each other so that they attract each other. Base unit 101 and front unit 104 may be assembled together as illustrated in FIG. 4. Once assembled together, ornamentation 106A is visible on one side of jewelry device 100 and ornamentation 106B is visible on other side of jewelry device 100 through opening 102A as depicted in FIG. 4. Front unit 104 may be detached from base unit 101 by pressing through base unit opening 102A whilst holding base unit 101 in place and pushing on insert ornamentation 106A. The force from pressing on insert ornamentation 106A will overcome the magnetic attraction holding together base unit 101 and front unit 104 causing the base unit 101 and front unit 104 to separate. Alternatively Front unit 104 may be detached from base unit 101 by holding base unit 101 and pulling on insert ridge 106C. In these ways front unit 104 may be detached and interchanged with similarly constructed front units bearing different ornamentation.

The construction details of the invention as shown in FIG. 1 to FIG. 4 are that the receptacle piece 102 may be made of metal, wood, plastic, or of any other sufficiently rigid material. Magnet 103 and magnet 105 may be made of any permanently magnetized substance such as neodymium or other rare earth minerals, ferrous materials such as steel and other iron alloys, or as synthetic resins impregnated with particles of magnetic material. Magnet 103 and magnet 105 may be of a similar or identical circumference. Insert 106 may be made of metal, wood, plastic, glass, or any other sufficiently rigid material or combination thereof. Insert 106 may be hollow or full and may be composed of multiple parts, or it may be molded, cast, or otherwise created as a single piece. In configurations where insert 106 is composed of a transparent material such as plastic or glass, ornamentation 106A, ornamentation 106B, or both ornamentations 106A and 106B may take the form of a visually appealing feature positioned beneath the transparent material such as photographs, gemstones, time pieces, or any other feature deemed visually desirable by the user. Although the present invention has previously been illustrated in terms of a circular shaped jewelry mechanism (circular shaped base unit 101 and front unit 104), any concentric shapes may be used for the construction of base unit 101 and front unit 104. Receptacle piece 102 is illustrated as having an opening 102A so side 106A of insert 106 may be visible, however receptacle 102 may also be constructed without opening 102A which may be particularly useful in allowing additional space for affixing base unit 101 to an article or component of jewelry such as a ring or bangle where it may not be necessary for the user to be able to see both sides of insert 106 and only one visible side may be sufficient.

Figure 5:
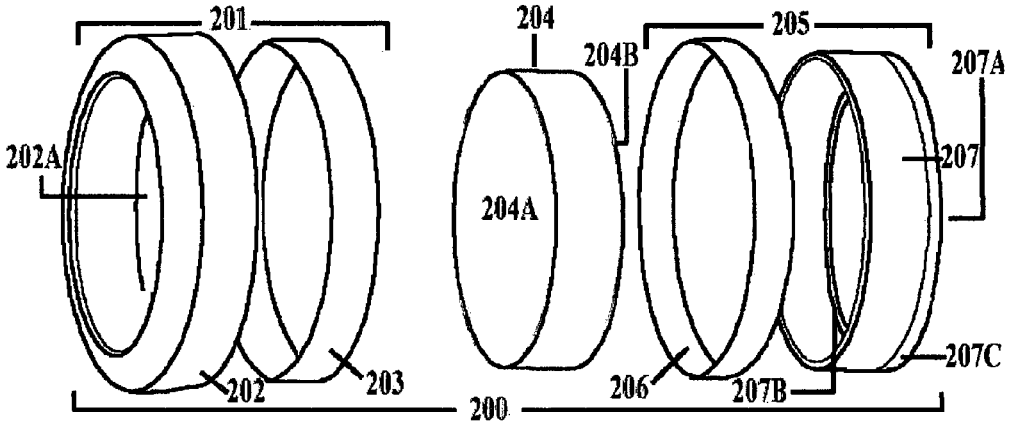
FIG. 5 is an exploded perspective view of a device of the present invention.

Referring now to FIG. 5 there is shown a modular jewelry device 200 comprised of a base unit 201, an insert 204, and a front unit 205.

The base unit 201 includes a magnet 203 and a back receptacle piece 202. Base unit 201 may be adapted to be worn on the person by affixing base unit 201 to a mounting such as a ring or a pendant bail. In FIG. 5. base unit 201 is not shown with such adaptation but it may, within the purview of the invention take on any number of forms such as for example a ring, a pendant, a cufflink, a bracelet, a bangle, a brooch, a tie clip, or an earring. The magnet 203 is of a shape as to fit inside the inner perimeter of the receptacle piece 202 and is secured in place via an adhesive (not shown). The back face of the back receptacle piece 202 may have an opening 202A as depicted in FIG. 5. Insert 204 is designed to fit inside front unit 205 and may be ornamented on the back face 204A, the front face 204B, both faces 204A and 204B, or neither face. The front unit 205 includes a magnet 206 and a front receptacle piece 207. Front receptacle piece 207 is of sufficient size and shape to fit inside base unit 201 and to fit around insert 204. Front receptacle piece 207 may have an external raised ridge 207C positioned behind magnet 206. Front receptacle piece 207 may also have an internal raised ridge positioned close to opening 207A. The magnet 206 is of a shape as to fit around the outside perimeter of front receptacle piece 207 and is secured in place via an adhesive (not shown).

In more detail, still referring to the invention of FIG. 5, insert 204 may be fitted inside the front unit 205 so that ornamented insert side 204B is visible through opening in front unit 207A. Combined front unit 205 and insert 204 are then inserted into base unit 201 so that ornamented insert side 204A is visible through base unit opening 202A. Front unit 205 and base unit 201 are held in place by force of magnetic attraction from magnet 203 on base unit 201 and magnet 206 on front unit 205 effectively locking in place insert 204. Magnet 203 and magnet 206 must be assembled on their respective bodies so that opposite poles are facing each other so that they attract each other.

Front unit 205 may be detached from base unit 201 by pressing through base unit opening 202A whilst holding base unit 201 in place and pushing on ornamentation 204A. The force from pressing on ornamentation 204A will overcome the magnetic attraction holding together base unit 201 and front unit 205 causing the base unit 201 and front unit 205 to separate. Insert 204 may then be removed from front unit 205 as it is no longer held in place by base unit 201. Alternatively Front unit 205 may be detached from base unit 201 by holding base unit 201 and pulling on insert ridge 207C. In this way insert 204 may be detached and interchanged with inserts of a similar size bearing different ornamentation.

The construction details of the invention as shown in FIG. 5 are that the back receptacle piece 202 and front receptacle piece 207 may be made of metal, wood, plastic, or of any other sufficiently rigid material. Magnet 203 and magnet 206 may be made of any permanently magnetized substance such as neodymium or other rare earth minerals, ferrous materials such as steel and other iron alloys, or as synthetic resins impregnated with particles of magnetic material. Magnets 203 and magnet 206 may be of a similar or identical circumference. Insert 204 may be made of metal, wood, plastic, glass, gemstone, or any other sufficiently rigid material or combination thereof. In configurations where insert 204 is composed of a transparent material such as plastic or glass, ornamentation 204A, ornamentation 204B, or both ornamentations 204A and 204B may take the form of a visually appealing feature positioned beneath the transparent material such as photographs, gemstones, time pieces, or any other feature deemed visually desirable by the user. Front receptacle piece 207 may be composed of multiple parts, or it may be molded, cast, or otherwise created as a single piece. Although the present invention has previously been illustrated in terms of a circular shaped jewelry mechanism (circular shaped base unit 201, circular shaped insert 204 and circular shaped front unit 205), any concentric shapes may be used for the construction of base unit 201, insert 204, and front unit 205. Back receptacle piece 202 is illustrated as having an opening 202A so side 204A of insert 204 may be visible, however receptacle 202 may also be constructed without opening 202A which may be particularly useful in allowing additional space for affixing base unit 201 to an article or component of jewelry such as a ring or bangle where it may not be necessary for the user to be able to see both sides of insert 204 and only one visible side may be sufficient.

The advantages of the present invention include, without limitation, that it allows for interchangeability between like jewelry items, locking mechanism is secure and subject to reduced wear and tear as it does not involve moving components. A common configuration for magnetic jewelry uses a flat magnet affixed to a side of an interchangeable component with a second flat magnet fixed to a base unit. This configuration has the disadvantage of allowing only one side of the interchangeable unit to be displayed by the wearer. It has an additional disadvantage in that the interchangeable unit itself must be affixed to the magnet or must be itself made of a magnetic material as in U.S. Pat. No. 4,912,944 whereas in certain configurations the present invention allows for an interchangeable insert to be used that is not magnetic or affixed to a magnet.

In broad embodiment, the present invention is a device with two or more components whereby one fits inside the other and utilizes a magnetic locking system created by surrounding the outer circumference of the male component with a magnet or magnets and surrounding the inner circumference of the female component with a magnet or magnets in such a way that when the two components are fitted together the magnets are likewise fitted together.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. An article comprising:

a front unit comprising an insert, a raised ridge, and a first magnet, wherein the first magnet and the raised ridge circumscribe an outside perimeter of the insert, with the first magnet positioned such that the first magnet rests on the raised ridge;

a base unit comprising a receptacle, a second magnet, wherein an inside perimeter of the receptacle circumscribes the second magnet;

wherein the base unit receives the front unit such that an outer circumferential surface of the first magnet is covered by the inside perimeter of the receptacle and the base unit is held in removable engagement with the front unit by force of magnetic attraction;

wherein the insert includes ornamentation, and the receptacle contains an opening which allows for the ornamentation to be visible through the opening when the base unit is assembled together with the front unit.

2. The article of claim 1, wherein the insert is composed of a transparent material.

3. An article comprising:

a front unit comprising an insert, a raised ridge, and a first magnet, wherein the first magnet and the raised ridge circumscribe an outside perimeter of the insert, with the first magnet positioned such that the first magnet rests on the raised ridge;

a base unit comprising a receptacle, a second magnet, wherein an inside perimeter of the receptacle circumscribes the second magnet;

wherein the base unit receives the front unit such that an outer circumferential surface of the first magnet is covered by the inside perimeter of the receptacle and the base unit is held in removable engagement with the front unit by force of magnetic attraction;

wherein the insert includes a central portion and a front receptacle portion, wherein the central portion is sandwiched between the receptacle of the base unit and the front receptacle portion of the front unit, allowing for interchangeability of the central portion with other similar central portions without changing the entire front unit.

4. The article of claim 3, wherein the central portion is composed of a transparent material.

5. The article of claim 3 or 4, wherein the central portion includes ornamentation, and the front receptacle portion includes an opening which allows for the ornamentation to be visible through the opening when the front unit is assembled together with the base unit.

6. The article of claim 5, wherein the receptacle of the base unit includes an opening which allows for the ornamentation to be visible through the opening when the base unit is assembled together with the front unit.

7. The article of claim 3 or 4, wherein the central portion includes ornamentation, and the receptacle of the base unit includes an opening which allows for the ornamentation to be visible through the opening when the base unit is assembled together with the front unit.

8. An article comprising:

a front unit comprising an insert, a raised ridge, and a first magnet, wherein the first magnet and the raised ridge circumscribe an outside perimeter of the insert, with the first magnet positioned such that the first magnet rests on the raised ridge;

a base unit comprising a receptacle, a second magnet, wherein an inside perimeter of the receptacle circumscribes the second magnet;

wherein the base unit receives the front unit such that an outer circumferential surface of the first magnet is covered by the inside perimeter of the receptacle and the base unit is held in removable engagement with the front unit by force of magnetic attraction;

wherein the insert is composed of transparent material.

* * * * *